US006995719B2

(12) United States Patent
Ide

(10) Patent No.: US 6,995,719 B2
(45) Date of Patent: Feb. 7, 2006

(54) MOBILE RADIO TERMINAL CONTAINING TWO ANTENNA ELEMENTS

(75) Inventor: Yoshiyuki Ide, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/893,356

(22) Filed: Jul. 19, 2004

(65) Prior Publication Data

US 2005/0012669 A1 Jan. 20, 2005

(30) Foreign Application Priority Data

Jul. 18, 2003 (JP) ..... 2003-276601

(51) Int. Cl.
*H01Q 1/24* (2006.01)

(52) U.S. Cl. ..... 343/702; 455/90; 455/562

(58) Field of Classification Search ..... 343/702, 343/725; 455/90, 562
See application file for complete search history.

(56) References Cited

U.S. PATENT DOCUMENTS 5,991,643 A 11/1999 Chao-Cheng ..... 455/562
6,600,450 B1 * 7/2003 Efanov et al. ..... 343/726
6,806,835 B2 * 10/2004 Iwai et al. ..... 343/702
2002/0094789 A1 7/2002 Harano ..... 455/90
2003/0013490 A1 1/2003 Shoji et al. ..... 455/562
2004/0027298 A1 * 2/2004 Iguchi et al. ..... 343/702

FOREIGN PATENT DOCUMENTS

| | | |
|---|---|---|
| EP | 1 211 749 A1 | 6/2002 |
| EP | 1 271 687 A1 | 1/2003 |
| JP | 11-177485 | 7/1999 |
| JP | 2002-261665 A | 9/2002 |
| WO | WO 02/054532 A1 | 7/2002 |

* cited by examiner

*Primary Examiner*—Hoang V. Nguyen
(74) *Attorney, Agent, or Firm*—Foley & Lardner LLP

(57) ABSTRACT

The present invention is applied to a mobile radio terminal having an upper body and lower body connected through a hinge mechanism. A first antenna element is disposed near the internal end of the lower body. A second antenna element is disposed between a battery cell within the lower body and the hinge mechanism. The second antenna element has a conductive three-dimensional structure. A radio circuit compares reception levels of the first antenna element and second antenna element and always selects one antenna element having a higher reception level.

6 Claims, 1 Drawing Sheet

MOBILE RADIO TERMINAL CONTAINING TWO ANTENNA ELEMENTS

This application claims priority to prior Japanese patent application JP 2003-276601, the disclosure of which is incorporated herein by reference.

BACKGROUND OF THE INVENTION

The present invention relates to a mobile radio terminal containing antennas and, in particular, to a mobile radio terminal containing two switchable antennas.

Conventionally, as an antenna for a small mobile radio terminal such as a mobile telephone, a self-contained antenna may be adopted. In this case, the self-contained antenna has a size which can hold a volume to some extent so as to keep communication performance. When a self-contained antenna is adopted, an antenna element may be disposed near the internal lower end of a body or casing of a mobile radio terminal. In this case, at some positions of the hand holding the body, the palm may cover the antenna element. As a result, the sensitivity of reception may decrease.

On the other hand, a mobile radio terminal having upper and lower bodies is provided and is known (such as Japanese Unexamined Patent Application Publication No. 11-177485, which will be called Document 1, hereinafter) in which these upper and lower bodies are connected through a hinge mechanism. Each of the upper and lower bodies contains an antenna element. Even when the sensitivity of reception of one antenna element decreases, the other antenna element is selected so that a decrease in sensitivity of reception of the mobile radio terminal can be prevented. Here, the two antenna elements in the mobile radio terminal are switched for a stand-by mode and a conversation mode. In other words, one antenna element is used only during a conversation while the other antenna element is used for a non-conversational, stand-by mode.

WO 02/0545332A1 (called Document 2, hereinafter) discloses a mobile radio termninal as described below. The mobile radio terminal has upper and lower bodies, and these upper and lower bodies are connected through a hinge mechanism. Each of the upper and lower bodies contains an antenna element. However, both of the two antenna elements are used as diversity antennas. Furthermore, one antenna element is disposed near the hinge mechanism in the lower body. Therefore, the lower body has a projection for accommodating the one antenna element at the upper part.

Yet, a mobile radio terminal disclosed in Document 1 and 2 includes two antenna elements separately contained in upper and lower bodies. One of the two antenna elements may be selected as required. Thus, in the hinge mechanism, an antenna connection line is required for one of the antenna elements.

A mobile radio terminal disclosed in Document 2 must have a special projection for containing an antenna element on the upper side of the lower body. Because of the existence of the projection, the length of the lower body is much larger than that of a general mobile radio terminal.

SUMMARY OF THE INVENTION

Accordingly, it is an object of the present invention to provide a mobile radio terminal which can contain two antenna elements without an increase in length of bodies thereof.

It Is another object of the present invention to provide a mobile radio terminal including a hinge mechanism coupling upper and lower bodies thereof without an antenna connection line through a hinge mechanism thereof.

The present invention is applied to a mobile radio terminal having upper and lower bodies coupled through a hinge mechanism.

According to a preferred aspect of the invention, the mobile radio terminal includes a first antenna element disposed near the internal lower end of a lower body and a second antenna element disposed between a battery cell within the lower body and a hinge mechanism. The second antenna element has a conductive three-dimensional structure.

In this case, the mobile radio terminal preferably further includes a switch circuit for comparing reception levels of the first antenna element and second antenna element and selecting one antenna element having a higher reception level.

The second antenna element is preferably disposed onto the internal rear surface of the lower body.

An insulating rib is preferably disposed between the second antenna element and the battery cell.

DESCRIPTION OF THE PREFERRED EMBODIMENT

Figure 1:
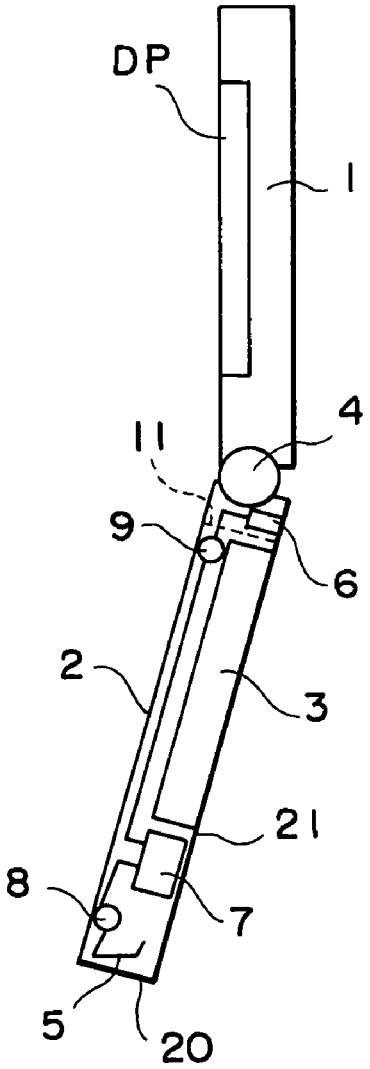
FIG. 1 is a side elevation view roughly showing an internal structure of a mobile radio terminal according to an embodiment of the present invention and, in particular, an internal structure of a lower body thereof.
Figure 2:
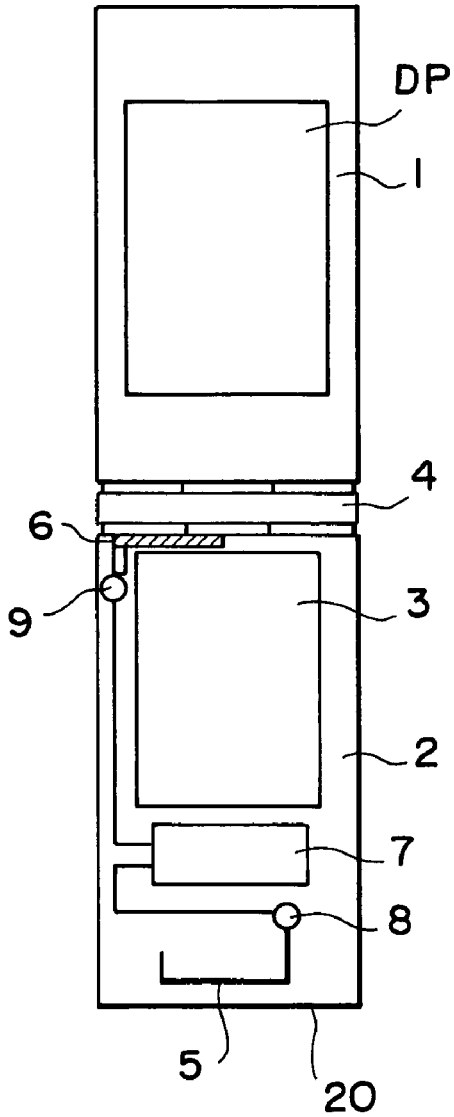
FIG. 2 is a front view roughly showing the internal structure of the mobile radio terminal according to the embodiment of the present invention and, in particular, the internal structure of the lower body.

A mobile radio terminal according to a preferred embodiment of the present invention will be described with reference to FIGS. 1 and 2. In FIGS. 1 and 2, the mobile radio terminal has an upper body 1 having a display portion and a lower body 2. The upper body 1 and the lower body 2 are openably and closeably connected with each other through a hinge mechanism 4. This kind of mobile radio terminal is called foldable mobile radio terminal.

The lower body 2 contains a circuit substrate (not shown), a battery cell 3 and a radio circuit 7. In particular, the battery cell 3 is disposed on a rear surface 21 of the lower body 2. A first antenna element 5 is disposed on the circuit substrate near an internal lower end 20 of the lower body 2. The first antenna element 5 has an L-shaped pattern. A second antenna element 6 is disposed near an internal upper end of the lower body 2, that is, between the battery cell 3 and the hinge mechanism 4. The second antenna element 6 has a three-dimensional structure of sheet metal such as U-shaped or L-shaped sheet metal.

The first antenna element 5 and the second antenna element 6 are connected to a radio circuit 7 through feeding points 8 and 9, respectively. The radio circuit 7 has a switch circuit (not shown). The switch circuit compares reception levels of the first antenna element 5 and second antenna element 6 and select one antenna having a higher reception level. Then, the selected antenna element can be used for transmission and reception.

According to this embodiment, the radio circuit 7 is disposed near the internal lower end of the lower body 2, that is, between the first antenna element 5 and the battery cell 3. However, the radio circuit 7 may be disposed near the internal upper end of the lower body 2. In this case, for example, the circuit substrate is disposed above the battery cell 3, and the radio circuit 7 is implemented on the circuit substrate. In addition to the switch circuit for the first and second antenna elements 5 and 6, the radio circuit 7 has a transmitter circuit and receiver circuit (both of which are not shown) in order to function as a mobile radio terminal. In addition to the radio circuit 7, a control circuit (not shown) is implemented on the circuit substrate.

As described above, the radio circuit 7 is connected to the first antenna element 5 and the second antenna element 6 in the lower body 2. The second antenna element 6 has a three-dimensional structure of sheet metal and is fixed onto the rear surface 21 of the lower body 2 by using a space between the battery cell 3 and the hinge mechanism 4.

The switch circuit included in the radio circuit 7 switches the first antenna element 5 and the second antenna element 6 under a predetermined condition. In other words, the switch circuit compares the reception levels of the first antenna element 5 and second antenna element 6 periodically and always selects a reception signal received by one antenna element having a higher reception level. For example, when the first antenna element 5 covered by the palm deteriorates the sensitivity of reception of the first antenna element 5, the reception signal received by the second antenna element 6 is selected. On the other hand, when the sensitivity of reception of the second antenna element 6 is deteriorated for some reason, the reception signal received by the first antenna element 5 is selected. The prevention of the deterioration of the sensitivity of reception in this way can improve the communication characteristic.

By the way, the second antenna element 6 includes a conductive three-dimensional structure of sheet metal according to this embodiment. The second antenna element 6 is also fixed onto the internal rear surface 21 of the lower body 2 by using a space, that is, a gap between the battery cell 3 and the hinge mechanism 4. Thus, the second antenna element 6 does not obstruct the implementation of the battery cell 3 and the circuit substrate.

As an improvement example of the above-mentioned embodiment, an insulating rib 11 shown by a dotted line In FIG. 1 may be provided between the second antenna element 6 and the battery cell 3 so as to keep from contact with each other. In this case, the insulating rib 11 extends from the rear surface 21 side to the front surface side.

Having described the present invention with respect to the preferred embodiment, the present invention is not limited to the above-mentioned embodiment. The mobile radio terminal according to the embodiment can be openably and closeably folded by connecting the upper body 1 and the lower body 2 through the hinge mechanism 4. However, a rotatable hinge mechanism may be used instead of the hinge mechanism 4. In this case, the upper body and the lower body are openably and closeably connected through the rotatable hinge mechanism, and, in the mobile radio terminal, the upper body can rotate in parallel to a surface of the lower body.

A mobile radio terminal according to the present invention is suitable for a mobile telephone requiring a size reduction. However, a mobile radio terminal according to the invention can be applied to general electronic equipment each including a mobile radio terminal having upper and lower bodies coupled through a hinge mechanism.

In a mobile radio terminal according to the present invention, a first antenna element is provided near the internal lower end of the lower body. A second antenna element has a conductive three-dimensional structure and is provided between a battery cell within the lower body and a hinge mechanism. In other words, the second antenna element can be disposed in a small space. As a result, the second antenna element does not obstruct the implementation of the battery cell and circuit substrate. Furthermore, the mobile radio terminal body and/or detriment to the appearance of the mobile radio terminal.

What is claimed is:

1. A mobile radio terminal having an upper body provided with a display portion and lower body connected through a hinge mechanism, the mobile radio terminal comprising:

a first antenna element disposed near the internal lower end of the lower body; and a second antenna element disposed between a battery cell within the lower body and the hinge mechanism, wherein the second antenna element has a conductive three-dimensional structure.

2. A mobile radio terminal according to claim 1, further comprising a switch circuit for comparing reception levels of the first antenna element and second antenna element and selecting one antenna element having a higher reception level.

3. A mobile radio terminal according to claim 2, wherein the second antenna element is disposed onto the internal rear surface of the lower body.

4. A mobile radio terminal according to claim 3, wherein an insulating rib is disposed between the second antenna element and the battery cell.

5. A mobile radio terminal according to claim 1, wherein the second antenna element is disposed onto the internal rear surface of the lower body.

6. A mobile radio terminal according to claim 5, wherein an insulating rib is disposed between the second antenna element and the battery cell.

* * * * *